US005154297A

United States Patent [19]

Farley

[11] Patent Number: 5,154,297

[45] Date of Patent: Oct. 13, 1992

[54] FOOT ASSEMBLY FOR SIMULATED PALLET

[75] Inventor: Charles Farley, Ortonville, Mich.

[73] Assignee: Aldon Pattern, Inc., Auburn Hills, Mich.

[21] Appl. No.: 754,068

[22] Filed: Sep. 3, 1991

[51] Int. Cl.[5] ..... B65D 19/00; B65D 85/62

[52] U.S. Cl. ..... 206/599; 206/512; 206/586; 206/453; 217/69

[58] Field of Search ..... 206/511, 512, 453, 586, 206/599; 217/69

[56] References Cited

U.S. PATENT DOCUMENTS

| | | | |
|---|---|---|---|
| 2,878,982 | 3/1959 | Gariepy | 206/586 |
| 3,331,496 | 7/1967 | Marsden et al. | 206/599 |
| 3,836,043 | 9/1974 | Levin | 206/512 X |
| 4,779,751 | 10/1988 | Munroe | 217/69 |
| 5,036,979 | 8/1991 | Selz | 206/512 |

FOREIGN PATENT DOCUMENTS

| | | | |
|---|---|---|---|
| 2731781 | 1/1979 | Fed. Rep. of Germany | 206/599 |
| 1520613 | 3/1968 | France | 206/511 |
| 2402591 | 5/1979 | France | 206/599 |

*Primary Examiner*—William I. Price

*Attorney, Agent, or Firm*—Gifford, Groh, Sprinkle, Patmore and Anderson

[57] ABSTRACT

A foot assembly is disclosed which is attachable to a box in order to simulate a pallet. The foot assembly includes a base having a foot extending outwardly from one side of the base. The opposite side of the base is secured to a lower corner of the box. With one foot assembly attached to each lower corner of the box, the foot assemblies space the bottom of the box upwardly from the ground supporting surface thereby simulating a pallet.

17 Claims, 1 Drawing Sheet

Fig-1
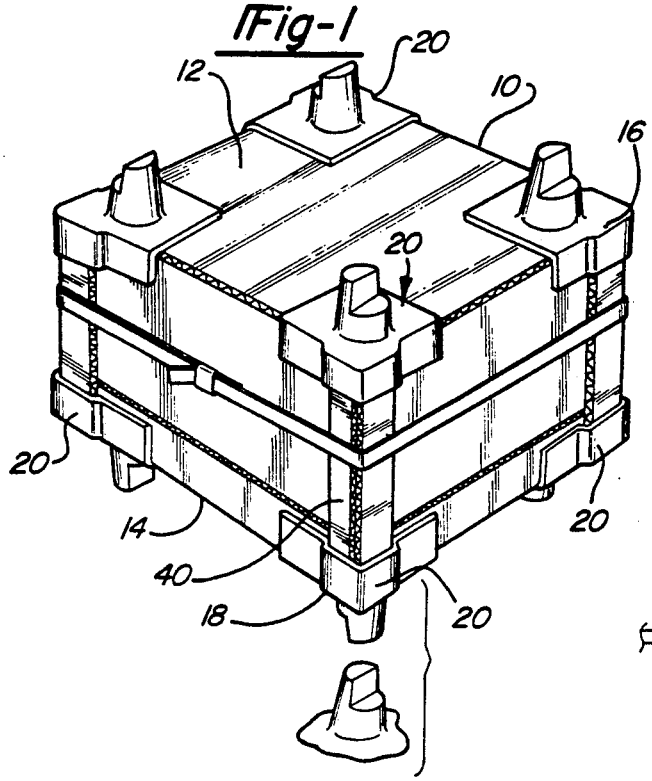
Fig-2
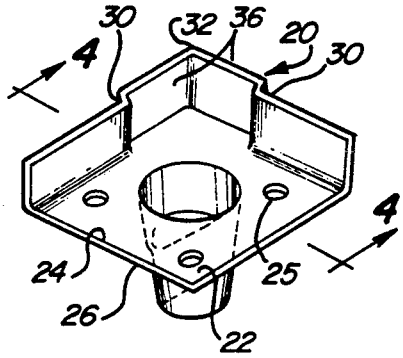
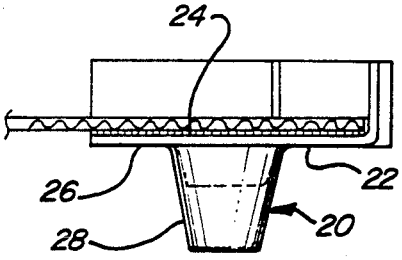
Fig-3
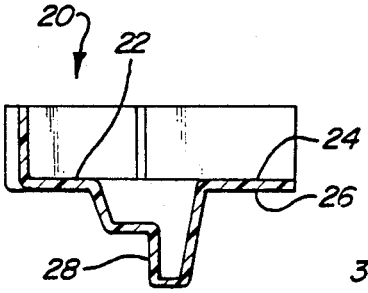
Fig-4
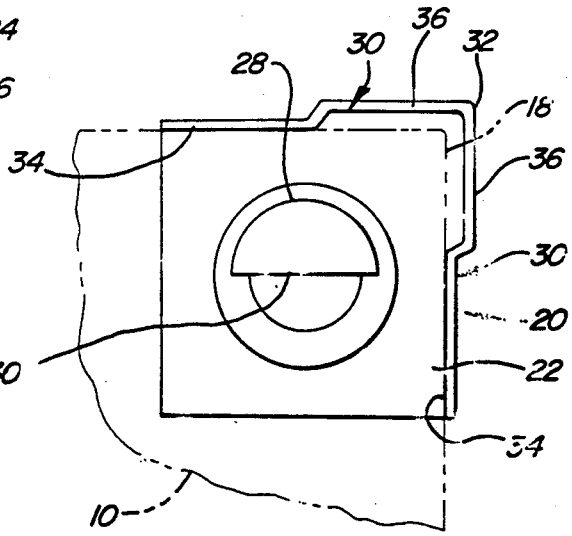
Fig-5

FOOT ASSEMBLY FOR SIMULATED PALLET

BACKGROUND OF THE INVENTION

I. Field of the Invention

The present invention relates to a foot assembly attachable to a box to thereby simulate a pallet.

II. Description of the Prior Art

In industrial applications, heavy loads are typically moved by forklift trucks. The load, such as a box, is typically mounted on a pallet which spaces the bottom of the box upwardly from the ground supporting surface. This space in turn provides room for entry of the fork of the forklift truck.

Many of these previously known pallets are constructed of wood and are thus relatively expensive to construct or purchase. Furthermore, such wooden pallets enjoy only a limited life span after which the pallet is discarded. Disposal of such worn out wooden pallets is also relatively expensive and ecologically undesirable.

One relatively modern replacement for the previously known wooden pallets is known as the "Buckboard" produced by Menasha Corporation of Menasha, Wis. This buckboard consists of a sheet of cardboard having a plurality of plastic feet secured to and extending outwardly from one side of the cardboard sheet.

In practice, the buckboard is attached to the bottom of the box so that the buckboard itself forms a pallet for the box. While the buckboard is effective in operation, it is relatively expensive to obtain.

SUMMARY OF THE INVENTION

The present invention provides a foot assembly for use with a box to simulate a pallet which overcomes all of the above mentioned disadvantages of the previously known devices.

In brief, the foot assembly of the present invention comprises a generally flat base having a first and second side. The first side of the base flatly abuts against the bottom of the box adjacent one of its corners. One foot assembly is provided at each corner of the box and glue or other suitable means attach the base of the foot assemblies to each lower corner of the box.

A foot extends outwardly from the second or other side of the base. Thus, with the foot assembly secured to each lower corner of the box, the foot assemblies space the bottom of the box upwardly from the ground supporting surface thereby simulating a pallet. The box can then be engaged and lifted by a forklift truck in the conventional fashion.

In a modification of the present invention, a foot assembly is also attached to each top corner of the box. Furthermore, each foot is constructed so that it nests with an inverted foot so that the boxes can be stacked one upon the other. When stacked in this fashion, the downwardly depending feet on one box nestingly engage the upwardly extending feet on the box below it.

Each base of the foot assembly also preferably includes means for securing a reinforcing strip, such as a cardboard strip, along the corner of the box. These reinforcing strips rigidify and strengthen the box and enable the boxes to be stacked without fear of crushing the boxes.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is an exploded elevational view illustrating a preferred embodiment of the present invention;

FIG. 2 is an elevational view illustrating one foot assembly of the preferred embodiment of the present invention;

FIG. 3 is an end view illustrating one foot assembly of the preferred embodiment of the present invention;

FIG. 4 is a crossectional view taken substantially along line 4—4 in FIG. 2; and FIG. 5 is a top view illustrating one foot assembly of the preferred embodiment of the present invention.

DETAILED DESCRIPTION OF A PREFERRED EMBODIMENT OF THE PRESENT INVENTION

With reference first to FIG. 1, a box 10 having a top 12 and a bottom 14. The box 10 is generally rectangular in shape and thus has four corners 16 along its top and, likewise, four corners 18 along its bottom. One lower corner 18 registers with each upper corner 16.

Still referring to FIG. 1, the present invention comprises a plurality of foot assemblies 20 wherein one foot assembly 20 is attached to each lower corner 18 of the box 10. As will be subsequently described in greater detail, by attaching the foot assemblies 20 to the lower box corners 18, a pallet is simulated so that the box 10 can be easily moved by a forklift truck.

With reference now to FIGS. 2–5, one foot assembly will now be described in greater detail, it being understood that the same description shall also apply to each of the foot assemblies 20.

The foot assembly 20 comprises a generally rectangular and planar base 22 having a first side 24 and a second side 26. As best shown in FIG. 3, the top side 24 of the base 22 is adapted to flatly abut against the box 10 adjacent its lower corner 18. Any conventional means, such as an adhesive 25, is used to secure the first side 24 of the base 22 against the box 10.

As best shown in FIGS. 3 and 4, a foot 28 protrudes outwardly from the second or lower side 26 of the base 22. This downwardly depending foot 28 is preferably formed so that it is nestable with an inverted foot 28 for a reason to be subsequently described. As such, the foot 28 includes a flat surface 20 which forms a nesting surface for an inverted foot. Other shapes for the foot 28, however, can alternatively be used and will be apparent to those skilled in the art.

Referring now particularly to FIGS. 2 and 5, the foot assembly 20 further includes a pair of sidewalls 30 which extend perpendicularly outwardly from the upper or first side 24 of the base 22. Furthermore, the sidewalls 30 are formed along adjacent sides of the base 22 and thus meet and are joined together in a corner 32.

As best shown in FIG. 5, at least a portion 34 of each sidewall 30 is adapted to flatly abut against the side of the box 10 and, in doing so, position the foot assembly 20 at the corner 18 of the box 10. Each sidewall 30, however, also preferably includes an outwardly protruding section 36 which is spaced outwardly from its associated side of the box 10 from the corner 32 of the sidewalls 30.

With reference now to FIG. 1, in order to rigidify the box 10 so that plural boxes 10 can be stacked, one foot assembly 20 is also preferably attached to each upper corner 16 of the box 10. In doing so, the outwardly protruding sidewall portion 30 of the foot assembly 20 at the lower corner 18 of the box 10 faces and registers with the same outwardly protruding portion 30 on the foot assembly 20 directly above it. Reinforcing strips 40, are then entrapped between the outwardly protruding portions 30 on the upper and lower foot assemblies 20 so that these reinforcing strips 40 extend along each vertically extending corner of the box 10. These reinforcing strips 40 thus rigidify the box 10 and allow additional boxes 10 to be stacked upon each other without fear of crushing the boxes.

In the preferred form of the invention, each foot assembly 20 is of a one piece construction and preferably constructed from plastic. Furthermore, the foot assemblies 20 can be nested one upon each other prior to use for compact storage and shipping. When use of the corner assemblies 20 is desired they can simply be individually removed from their shipping container and then attached to the box 10 in the previously described fashion.

Having described my invention, however, many modifications thereto will become apparent to those skilled in the art to which it pertains without deviation from the spirit of the invention as defined by the scope of the appended claims.

I claim:

1. A foot assembly attachable to a box to simulate a pallet, said foot comprising:

a generally flat base having a first and second side, said first side of said base adapted to flatly abut against the box adjacent a corner of the box, means for attaching said one side of said base to the box, a foot extending outwardly from the second side of said base, wherein with one foot assembly attached to each corner of the box, said foot assemblies simulate a pallet, wherein said sidewalls each include an outwardly protruding section extending from said base corner along a portion of the length of each sidewall, said outwardly protruding section being adapted to receive a reinforcing strip between the box and said outwardly protruding section.

2. The invention as defined in claim 1 wherein said attaching means comprises glue.

3. The invention as defined in claim 1 wherein said foot and said base are of a one piece construction.

4. The invention as defined in claim 3 wherein said foot and said base are constructed of plastic.

5. The invention as defined in claim 1 wherein said foot assembly further comprises two sidewalls, said sidewalls extending perpendicularly outwardly from an outer periphery of said first side of said base, said sidewalls adapted to abut against intersection sides of said box.

6. The invention as defined in claim 5 wherein said sidewalls intersect each other and are joined together to form a corner on said base.

7. A simulated pallet comprising:

a box having a plurality of lower corners, a plurality of foot assemblies, each foot assembly comprising a generally flat base having a first and second side, said first side of said base adapted to flatly abut against the box adjacent one lower corner of said box, means for attaching said one side of said base to each lower corner of said box, a foot extending outwardly from the second side of said base, wherein with one foot assembly attached to each lower corner of said box, said foot assemblies simulate a pallet for said box, wherein said sidewalls each include an outwardly protruding section extending from said base corner along a portion of the length of each sidewall, said outwardly protruding section being adapted to receive a reinforcing strip between the box and said outwardly protruding section.

8. The invention as defined in claim 7 wherein said attaching means comprises glue.

9. The invention as defined in claim 7 wherein said foot and said base are of a one piece construction.

10. The invention as defined in claim 9 wherein said foot and said base are constructed of plastic.

11. The invention as defined in claim 7 wherein said foot assembly further comprises two sidewalls, said sidewalls extending perpendicularly outwardly from an outer periphery of said first side of said base, said sidewalls adapted to abut against intersecting sides of said box.

12. The invention as defined in claim 11 wherein said sidewalls intersect each other and are joined together to form a corner on said base.

13. A foot assembly attachable to a box to simulate a pallet, said foot comprising:

a generally flat base having a first and second side, said first side of said base adapted to flatly abut against the box adjacent a corner of the box, means for attaching said one side of said base to the box, a foot extending outwardly from the second side of said base, wherein with one foot assembly attached to each corner of the box, said foot assemblies simulate a pallet, wherein each foot includes a stepped surface so that said stepped surface of said foot overlaps the stepped surface of an inverted foot such that a portion of said stepped surfaces abut against each other.

14. The invention as defined in claim 13, wherein said foot and said base are of a one piece construction.

15. The invention as defined in claim 14 wherein said foot and said base are constructed of plastic.

16. The invention as defined in claim 13 wherein said foot assembly further comprises two sidewalls, said sidewalls extending perpendicularly outwardly from an outer periphery of said first side of said base, said sidewalls adapted to abut against intersection sides of said box.

17. The invention as defined in claim 16 wherein said sidewalls intersect each other and are joined together to form a corner on said base.

* * * * *